United States Patent [19]

Swanson

[11] Patent Number: 4,821,787

[45] Date of Patent: Apr. 18, 1989

[54] FLEX PANEL SYSTEM

[75] Inventor: Wesley W. Swanson, Glastonbury, Conn.

[73] Assignee: Harold Post, West Hartford, Conn.

[21] Appl. No.: 161,411

[22] Filed: Feb. 23, 1988

Related U.S. Application Data

[63] Continuation of Ser. No. 921,314, Oct. 21, 1986, abandoned.

[51] Int. Cl.[4] ..... A47G 5/00

[52] U.S. Cl. ..... 160/135; 160/231.1; 52/71

[58] Field of Search ..... 160/135, 351, 352, 231.1, 160/231.2, 232, 236; 52/71, 800, 388, 631; 40/605, 606, 610

[56] References Cited

U.S. PATENT DOCUMENTS

| | | | |
|---|---|---|---|
| 3,084,403 | 4/1963 | Elmendorf | 160/231 R |
| 3,319,801 | 5/1967 | Nordstrom | 160/135 X |
| 3,592,289 | 7/1971 | Aysta | 160/135 |
| 4,047,337 | 9/1977 | Bergstrom | 160/135 X |
| 4,129,163 | 12/1978 | Johnson | 160/135 |
| 4,194,313 | 3/1980 | Downing | 160/135 X |
| 4,257,207 | 3/1981 | Davis | 52/631 X |
| 4,375,829 | 3/1983 | Dorr et al. | 160/135 |
| 4,497,356 | 2/1985 | Luck et al. | 160/135 |
| 4,516,619 | 5/1985 | Hasbrouck | 160/135 |
| 4,531,564 | 7/1985 | Hanna | 160/229 R X |
| 4,566,211 | 1/1986 | Gustafson et al. | 40/605 |
| 4,631,881 | 12/1986 | Charman | 160/135 X |
| 4,704,837 | 11/1987 | Menchetti et al. | 52/71 X |
| 4,712,336 | 12/1987 | Backer | 52/71 |

OTHER PUBLICATIONS

Verispanel Design.

*Primary Examiner*—Ramon S. Britts
*Assistant Examiner*—David M. Purol
*Attorney, Agent, or Firm*—Fishman, Dionne & Cantor

[57] ABSTRACT

A flexible multi-panel system for use as exhibits, partitions or backdrops in tradeshow, convention, or other such displays is presented. The system includes a flexible panel having a plurality of individual, longitudinal members or segments flexibly interconnected to one another. The panel is capable of being formed into straight, angled and/or curved configurations and includes devices for locking the panel in such desired angular configurations. This locking is accomplished by grooves which are provided at the top and/or bottom of each of the individual flexibly interconnected members. The grooves accept locking devices for rigidizing adjacent segments of the panel into a desired shape. Preferably, a textured carpeting or similar decorative covering material is provided on the outside of each of the longitudinal members with the decorative carpeting acting as the flexible interconnect or hinge between each member. Suitable panel interconnects are provided along the end members of each panel for interlocking one panel with another panel. Preferably, the individual members or segments are comprised of a lightweight material such as a honeycomb plastic or cardboard. At least one of the longitudinal members may be provided with a conduit for accepting electrical wiring.

19 Claims, 3 Drawing Sheets

FLEX PANEL SYSTEM

This is a continuation of co-pending application Ser. No. 921,314, filed on Oct. 21, 1986, now abandoned.

BACKGROUND OF THE INVENTION

This invention relates to a portable, flexible, multi-panel system for use in applications necessitating partitions and backdrops. The flexible panel of the present invention is ideally suited for use in trade shows and other applications necessitating exhibits wherein easily transportable interiors, partitions and backdrops are needed which are lightweight, sound absorbent, inexpensive to manufacture and permit cost effective shipping and storage.

It will be appreciated that businesses of all types participate in tradeshows, symposiums, seminars and other such events. In these tradeshows and conventions, each business will typically have its own exhibit or booth for displaying and illustrating the businesses goods and/or services. Such displays are usually constructed at a location remote from the convention or tradeshow. The exhibits are constructed from a variety of materials including wood, plastic and metal; and are intended to have an aesthetically pleasing and informative overall look. As a result however, the displays and exhibits are often quite bulky, cumbersome, heavy and require an enormous amount of labor to build, particularly due to the fact that most of such exhibits are custom made. The labor intensive nature, bulkiness and large weight of the displays lead to extremely high costs, both in the initial construction of the exhibits as well as in the shipping and storage thereof. Moreover, with regard to shipping, often large shipping crates have to be custom manufactured in order to fit a particular display leading to even higher costs. An average cost for such exhibits and displays can run a thousand dollars a linear foot.

In view of the foregoing, there is a perceived need for providing a portable exhibit for use in tradeshow displays and similar applications, wherein the exhibit will be inexpensive to manufacture, and have a light weight and compact assembly which will lead to cost effective shipping, storage and labor (i.e., manufacturing) costs.

SUMMARY OF THE INVENTION

The above-described and other problems and deficiencies of the prior art are overcome or alleviated by the flexible multi-panel system for use as exhibits, partitions or backdrops in tradeshow, convention, or other such displays of the present invention. In accordance with the present invention, a flexible panel comprised of a plurality of individual, longitudinal members or segments flexibly interconnected to one another is provided. The panel is capable of being formed into straight, angled and/or curved configurations with means for locking the panel in such desired angular configurations. This locking is accomplished by grooves which are provided at the top and/or bottom of each of the individual, flexibly interconnected members. The grooves accept locking means for rigidizing adjacent segments of the panel into a desired shape. Preferably, a textured carpeting or similar decorative covering material is provided on the outside of each of the longitudinal members with the decorative carpeting acting as the flexible interconnect or hinge between each member. Means are provided along the end members of each panel for interlocking one panel with another panel. Preferably, the individual members or segments are comprised of a lightweight material such as a honeycomb plastic or cardboard. At least one of the longitudinal members may be provided with a conduit for accepting electrical wiring.

The flexible panel of the present invention can be easily reassembled to fit any new configuration requirements simply by removing the interlocking means and reconfiguring the interconnected longitudinal segments followed by rigidizing the the new configuration with the interlocking means. Use of a carpeting material as the exterior layer on the individual segments not only provides flexible interconnecting, but also provides an aesthetically attractive appearance and significantly, permits the use of velcro or similar hook and loop material to be used in conjunction with the panel.

The flexible panel of the present invention is lightweight, sound absorbent, and requires far less labor to construct relative to the labor intensive exhibits and tradeshow displays of the prior art. A very important feature of the present invention is that during shipping and storage, each individual panel section comprised of the individual interconnected segments can have the locking means removed therefrom so that the sections can be packed flat for low cost shipping and storage.

The above-described and other features and advantages of the present invention will be appreciated and understood to those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Referring first to FIGS. 1–3 and 7, an individual flexible panel in accordance with the present invention is shown generally at 10. It will be appreciated that the height of the panel may vary depending upon the selected application. Accordingly, the panel has been broken or cut off in the center thereof to indicate that the specific height may vary according to desired use.

Figure 2:
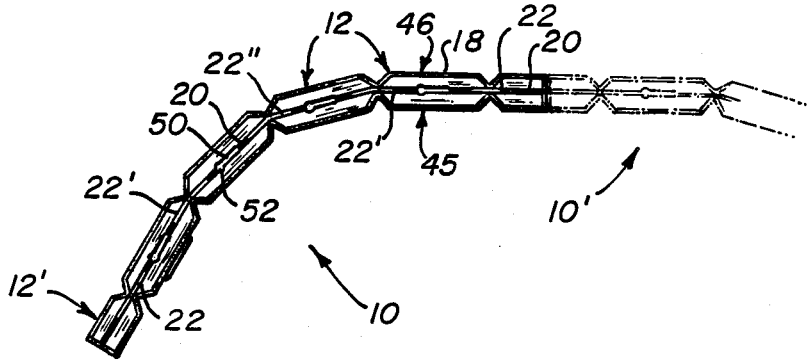
FIG. 2 is a plan view of the panel of FIG. 1.
Figure 3:
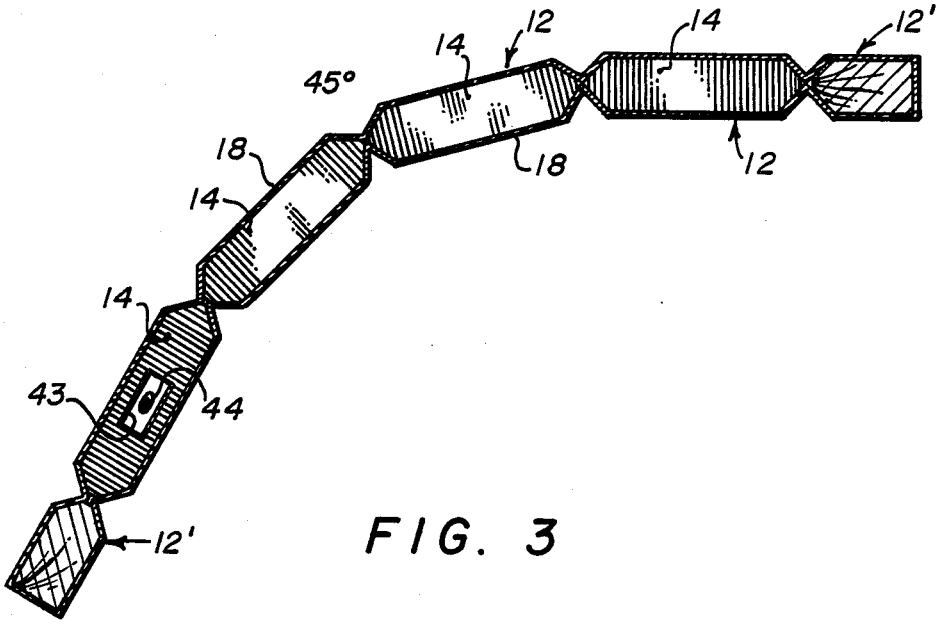
FIG. 3 is a cross-sectional elevation view along the line 3—3 of FIG. 1.

Panel 10 is comprised of a plurality of individual longitudinal segments or members identified at 12. Each segment or member 12 is preferably six sided to form a hexagonal cross-section (see FIGS. 2, 3, and 7). An individual segment or member 12 is preferably comprised substantially of a core 14 as shown in FIGS. 2 and 3. Core 14 should be lightweight and have the ability to support heavy objects applied thereto for display purposes. Core 14 should also provide suitable rigidity and structural integrity in the longitudinal direction. In a preferred embodiment, core 14 is compised of a honeycomb plastic or cardboard. Opposed ends of longitudinal segments 12 (actually core 14) are capped by solid blocks 16, comprised from a material such as wood or plastic. Such a solid block 16 will protect honeycomb core 14 from being crushed or damaged and will also provide a housing or base for grooving as will be discussed hereinafter.

Lightweight inner core 14 and end blocks 16 are covered by an outer covering 18 which serves several purposes. Significantly, outer covering 18 acts to flexibly interconnect each individual segment 12. Outer covering 18 also functions to provide an aesthetically pleasing appearance to the panel which is typically a necessary and important requirement for the preferred application of the panel as a display exhibit. Preferably, outer covering 18 is comprised of a sturdy, rich textured carpeting material. It has been found that the angle of the hexagonal joint (as shown in FIG. 3) should be about 45 degrees in order to provide the best flexibility between adjacent segments interconnected by outer covering 18.

Figure 1:
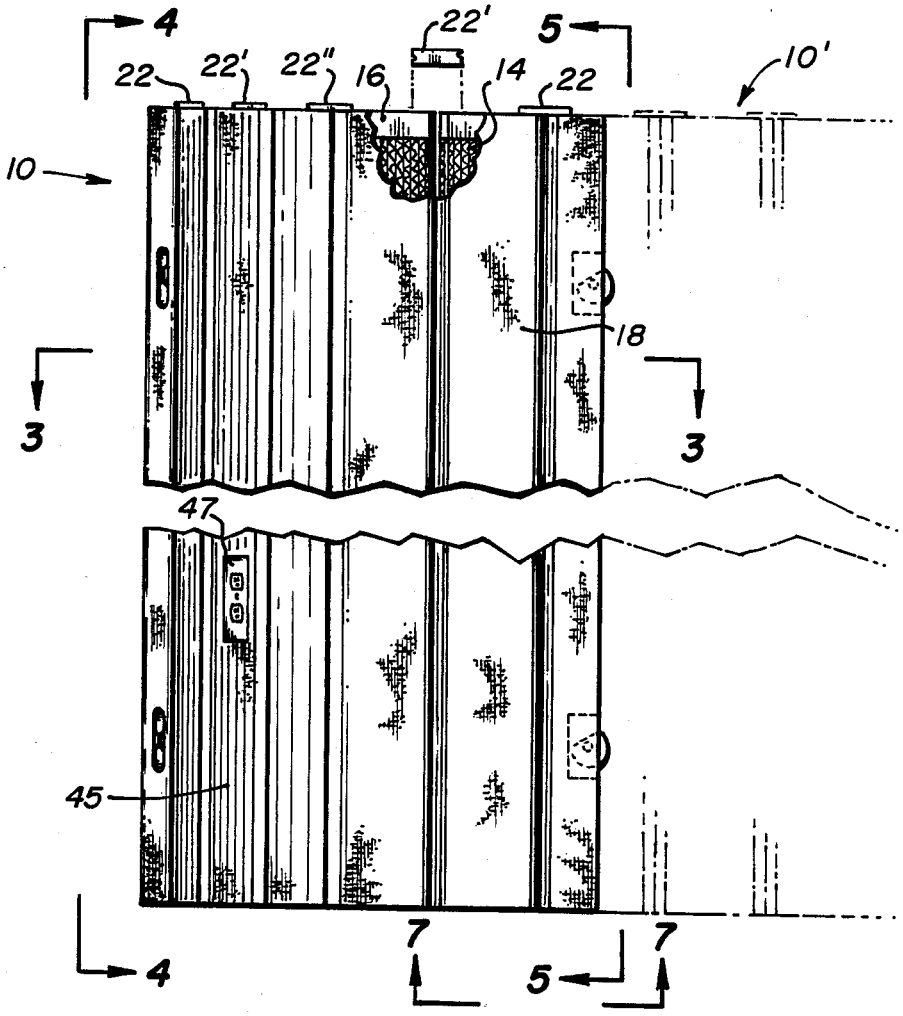
FIG. 1 is a front elevation view of a flexible panel in accordance with the present invention.
Figure 7:
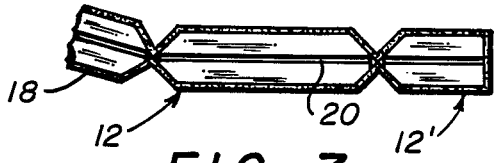
FIG. 7 is bottom view along the line 7—7 of FIG. 1.

Panel 10, comprised of the plurality of individual longitudinal segments 12, can thus be flexed into a variety of straight, curved or angled configurations with the area (comprised of outer covering 18) between each individual segment 12 acting as a hinge. An important feature of the present invention is the ability to rigidize panel 10 into a particular configuration subsequent to aligning the individual segments as desired. In order to achieve and rigidize panel 10 into such a desired configuration, each individual segment 12 is provided with a groove 20 in either or both the top and bottom end blocks 16 as is shown in FIGS. 2 and 7. Groove 20 is dimensioned to receive a variety of pre-configured rigid wedges or interlocking means 22. Wedges or interlocking means 22 have several different shapes including straight and a variety of angles. Thus, depending upon the relative position between two adjacent segments 12, an interlocking means 22 having a straight, 30 degree, 45 degree, etc. configuration will be inserted into groove 20 between two adjacent segments 12 and force fit therein to thereby lock the two adjacent segments in a desired angular orientation. In FIGS. 1 and 2, a wedge having a straight configuration is shown at 22 while wedges having an angle of 30 degrees and 45 degrees are shown at 22' and 22", respectively. Of course, wedges having any angled configuration may be used in the present invention with wedges 22, 22' and 22" being shown for example only. Wedges 22 are preferably comprised of steel and may be inserted in grooves 20 in either one of the top or bottom, or both blocks 16. When the locking wedges 22 are removed from grooves 20, the individual segments 12 flexibly interconnected by outer covering 18 will revert back to a flat planar configuration for ease of storage and transport.

Figure 6:
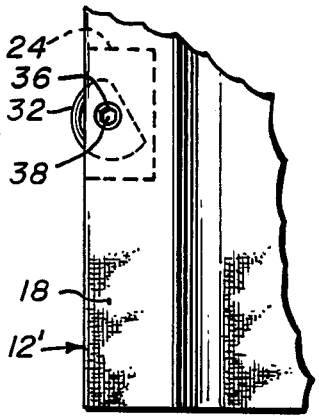
FIG. 6 is a rear elevation view along the line 6—6 of FIG. 5.
Figure 8:
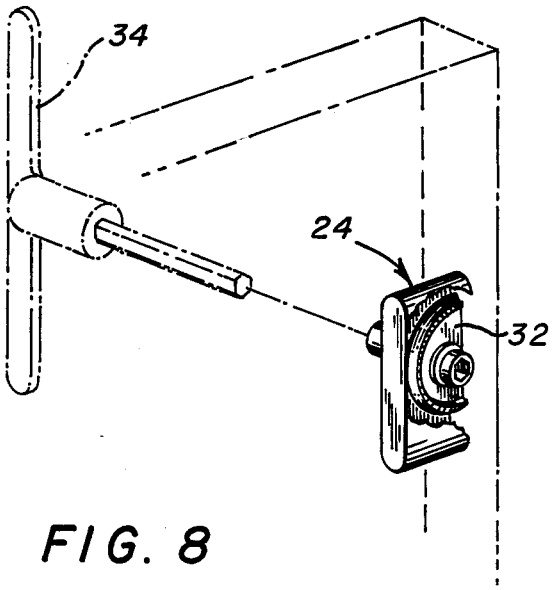
FIG. 8 is an enlarged perspective view of the male panel interlocking means used in conjunction with the panel of FIG. 1.
Figure 9:
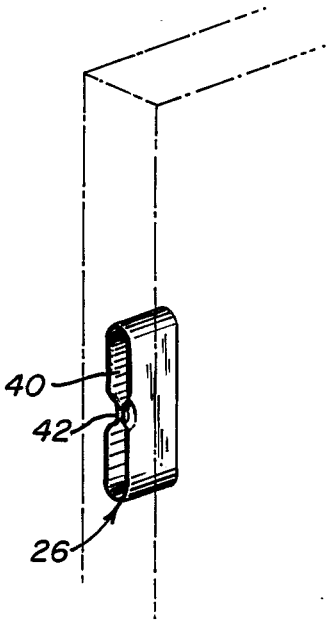
FIG. 9 is an enlarged perspective view of the female panel interlocking means used in conjunction with the panel of FIG. 1.

Preferably, each end of panel 10 will include a longitudinal segment or member 12' comprised of a solid material (as distinguished from the honeybomb core 14) such as wood or plastic. The use of a solid end member 12' is important in providing sufficient overall strength to the panel as well as providing a housing for panel interlocking means which to act interconnect one panel with another. In a preferred embodiment, such panel interlocking means takes the form of cooperating male and female interlocks. Referring now to FIGS. 1, 4–6, 8 and 9, the male interlock means is identified at 24 and the female interlock means is identified at 26. The panel interlocks shown at 24 and 26 are received in an opening 28 and 30, respectively provided in end members 12' of panel 10. Male and female panel interlocks 24 and 26 are preferably of the commercially available type sold under the trade name Roto-lock by the Simmon Fastener Corporation. Male interlock 24 includes a rotating cam 32 which is actuated and turned by a suitable wrench 34 (see FIG. 8) via a hexagonal nut 36. Hexagonal nut 36 is accessed by a latitudinal opening 38 through one side of end panel 12' as is shown in FIG. 6. Female panel interlock member 26 is comprised of a recess 40 having a centrally located latch 42 which is adapted to be engaged by rotating cam 32. Referring to FIG. 1, a second panel 10' is shown in phantom which has been interconnected with panel 10 via suitable male and female interlocks 24 and 26. FIGS. 8 and 9 are representative of male and female interlocks 24 and 26 in an open position prior to being abutted and connected. The use of the interlocks described above permit any number of panels 10 to be interconnected depending upon the desired length of the exhibit or the like. Of course, it will be appreciated that other types of panel interlocking means may be utilized with panel 10 so long as a plurality of panels may be adjacently connected to form variable lengths depending upon the application. It will of course also be appreciated that panels 10 and 10' may be easily disengaged by interlocks 24 and 26 to permit stacking of the panels for storage and shipment.

Figure 4:
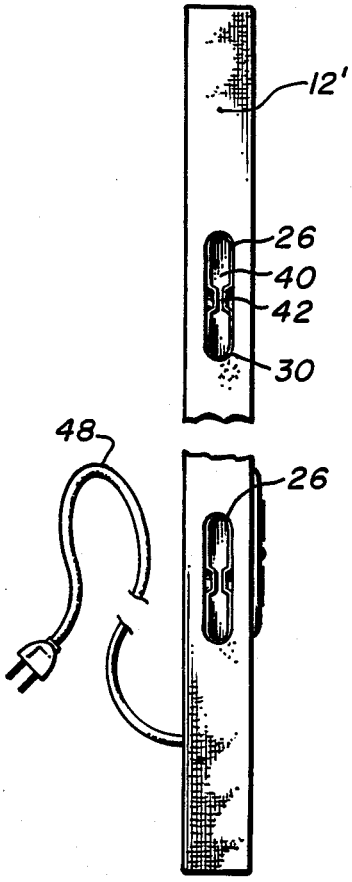
FIG. 4 is a left side elevation view along the line 4—4 of FIG. 1.
Figure 5:
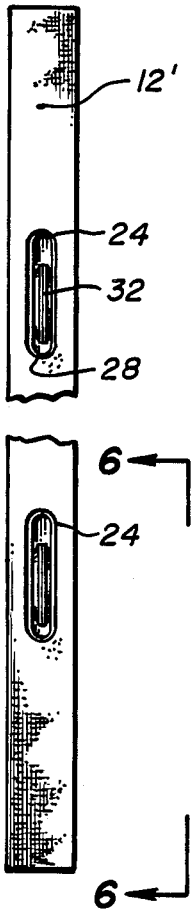
FIG. 5 is a right side elevation view along the line 5—5 of FIG. 1.

It is often desirable to provide electrification to a flexible panel in accordance with the present invention. Referring now to FIGS. 3 and 4, electrification is provided by insertion of a conduit 43 which runs vertically through the inside of at least one segment 12. Conduit 43 may be comprised of simply an opening formed through segment 12 or, in order to satisfy electrical code requirements, is often comprised of a lightweight aluminum or other suitable material. As shown in FIG. 3, electrical wiring 44 is then provided within conduit 43. Wiring 44 can terminate anywhere upon the front face 45 or back face 46 of segment 12 and be connected to a suitable wiring receptical such as is shown by the duplex socket 47 in FIG. 1. Wiring 44 can originate at either a recessed plug (not shown) or alternatively may terminate at a plug ended cord 48 as is shown in FIG. 4.

Figure 10:
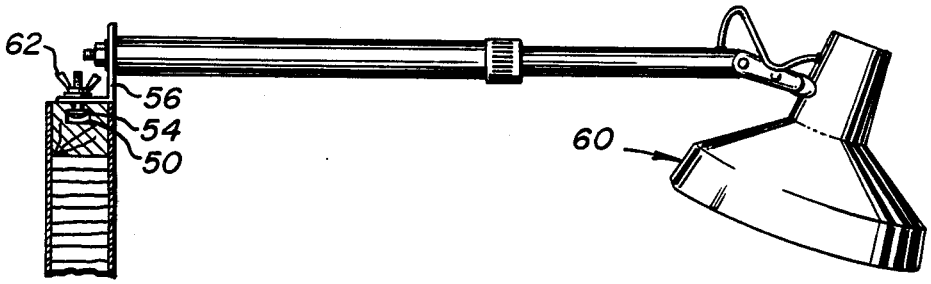
FIG. 10 is a side elevation view, partly in cross-section, of a lamp which may be used in conjunction with the panel of FIG. 1.

Turning now to a discussion of FIGS. 2 and 10, it will be appreciated that groove 20 may have an additional wider recess in some sections thereof as is identified at 50 in FIG. 2. Wider recess 50 communicates with groove 20 and also includes a circular opening 52 at one end thereof. Opening 52 is sized to receive a bolt or other male member 54 which is connected to an L shaped or other shaped angle iron 56 having a lighting device 60 attached thereto. A wing nut 62 or other fastening means is threadably attached to bolt 54. Thus, the head of bolt 54 may be lowered through opening 52 and then slideably urged along recess 50 to a desired location. At that point, wing nut 62 may be tightened onto bolt 54 thereby securing lighting fixture 60 at a desired location along the top portion of panel 10.

Figure 11:
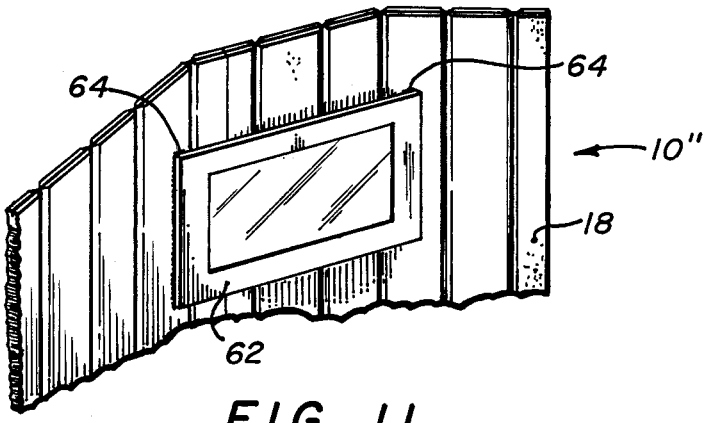
FIG. 11 is a perspective view of a light frame for use in conjunction with the panel of FIG. 1 in accordance with the present invention.

As previously mentioned, in a preferred embodiment, outer covering 18 is comprised of a material such as an aesthetically pleasing carpeting or any other material which is capable of being used in conjunction with Velcro or similar hook and loop material for adhering objects onto outer covering 18. Referring now to FIG. 11, a light box 62 is shown attached to a panel 10'' through the use of a Velcro or similar hook and loop material 64 which is adhered onto outer covering 18. It will be appreciated that light box 62 may be comprised of a relatively simple, light weight frame for use in conjunction with the hook and loop material. This is in distinct contrast to prior art bulky, cumbersome light boxes which had to be nailed, bolted, or otherwise secured to the heavier constructed prior art exhibits described hereinabove. Light box 62 shown in FIG. 11 may be used in conjunction with a light such as shown at 60 in FIG. 10 mounted along the top portion of frame 10''.

While the foregoing description of the present invention has been with regard to exhibits and displays for use in tradeshows, conventions and the like, it will be appreciated that the panel system of the present invention may also be used in other applications necessitating portable wall units. Such additional applications including room dividers for use in offices and homes; and for constructing counters and pedestals.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A flexible panel comprising:

a plurality of adjacent longitudinal members, each member including a core having top and bottom portions, said cores having a flexible outer covering thereon, said outer covering interconnecting at least two of said adjacent longitudinal members to define a flexible hinge between said two adjacent members;

a groove in at least one of said top and bottom portions of said cores defining at least a pair of grooves, said grooves having a preselected width and being respectively aligned in said two adjacent longitudinal members to define a continuous uninterrupted groove between said two adjacent longitudinal members;

means for locking said flexibly connected adjacent members in a preselected angular configuration, said means for locking comprising a rigid flattened insert which is insertable in said continuous uninterrupted groove of said two adjacent longitudinal members to thereby lock said members in said preselected angular configuration, said rigid insert having a preselected angle corresponding to the preselected configuration desired between said two adjacent members, said preselected groove width adapted for receiving said rigid insert; and said rigid flattened insert having a thickness dimension which is small relative to the width and length dimensions thereof, said thickness dimension of said insert forming a friction fit with said preselected width of said grooves to thereby lock said adjacent longitudinal members.

2. The panel of claim 1 wherein said core members include:

a groove in at least one of said top and bottom portions of said core, said groove having a preselected width and being respectively aligned in said two adjacent longitudinal members; and wherein said locking means is insertable in said grooves of said two adjacent longitudinal members to thereby lock said members in said pre-selected angular configuration.

3. The panel of claim 1 including:

block means on said top and bottom portions of said core of at least some of said longitudinal members, said groove being provided in said block means.

4. The panel of claim 3 wherein:

at least a portion of said core between said block means is comprised of a honeycomb material.

5. The panel of claim 4 wherein:

said honeycomb material is plastic.

6. The panel of claim 3 wherein:

said block means is wood.

7. The panel of claim 1 wherein:

said plurality of longitudinal members define two opposed end members having central members flexibly connected therebetween, and wherein at least said central members have opposed tapered sides.

8. The panel of claim 7 wherein:

said opposed tapered sides taper at about a 45 degree angle.

9. The panel of claim 7 wherein:

at least said central members have a hexagonal horizontal cross-section.

10. The panel of claim 7 wherein;

said opposed end members include means for interlocking with end members from another flexible panel.

11. The panel of claim 10 wherein said means for interlocking includes:

female interlocking means in one of said opposed end members; and male interlocking means in the other of said opposed end members.

12. The panel of claim 1 wherein:

said outer covering is a fabric carpeting material.

13. The panel of claim 1 including:

conduit means running through at least a portion of at least one of said longitudinal members, said conduit means being adapted for receiving electrical wiring.

14. The panel of claim 1 including:

a recess disposed over a portion of said groove, said recess having a width larger than said groove; and an opening in said recess.

15. The panel of claim 14 including:

light means disposed in said recess.

16. The panel of claim 13 including:

electrical wiring in said conduit means.

17. The panel of claim 4 wherein:

said honeycomb material is cardboard.

18. The panel of claim 3 wherein:

said block means is plastic.

19. The panel of claim 1 wherein:

said grooves in two adjacent longitudial member communicate with each other.

* * * * *